US006920998B2

(12) United States Patent
Diamond

(10) Patent No.: US 6,920,998 B2
(45) Date of Patent: Jul. 26, 2005

(54) CONTAINER WITH CHILD DROWNING PROTECTION

(75) Inventor: David W. Diamond, Dudley, MA (US)

(73) Assignee: Plastican, Inc., Leominster, MA (US)

( * ) Notice: Subject to any disclaimer, the term of this patent is extended or adjusted under 35 U.S.C. 154(b) by 43 days.

(21) Appl. No.: 10/600,971

(22) Filed: Jun. 20, 2003

(65) Prior Publication Data

US 2004/0256275 A1 Dec. 23, 2004

(51) Int. Cl.[7] ..... B65D 43/03

(52) U.S. Cl. ..... 220/781; 220/603; 220/604; 220/606; 220/608; 206/508

(58) Field of Search ..... 220/603, 604–606, 220/608, 780; 206/508, 509

(56) References Cited

U.S. PATENT DOCUMENTS 2,412,325 A * 12/1946 Devine et al. ..... 206/508
2,614,727 A * 10/1952 Robinson ..... 220/780
2,978,142 A * 4/1961 Novick ..... 206/508
3,362,575 A * 1/1968 Fotos ..... 206/508
4,648,522 A * 3/1987 Wise ..... 206/519
5,183,179 A 2/1993 Morris, Sr.
5,513,770 A * 5/1996 Seeley et al. ..... 220/729
6,024,244 A * 2/2000 Hicks ..... 220/603
6,047,847 A * 4/2000 Scott ..... 220/631
6,257,441 B1 7/2001 Maley

* cited by examiner

*Primary Examiner*—Robin A. Hylton
(74) *Attorney, Agent, or Firm*—Pandiscio & Pandiscio

(57) ABSTRACT

A container is provided with child drowning protection in the form of a bottom wall that is contoured in a manner that (1) allows it to stand upright on a flat support such as a floor, shelf or shipping pallet, and (2) in the event that the container contains some water or other liquid and a toddler leans forward into the container, e.g., in an attempt to retrieve a toy that has fallen into the container, the weight of the child on the container will cause the container to tip over, thereby spilling the contents and preventing the child from drowning in the container. Containers embodying the invention may be provided with covers that facilitate stacking covered containers one on top of the other. Additionally, the containers may be formed with an inclined sidewall, whereby to permit a plurality of open empty containers to be nested one inside the other.

20 Claims, 5 Drawing Sheets

CONTAINER WITH CHILD DROWNING PROTECTION

FIELD OF THE INVENTION

This invention relates to portable containers for diverse products such as food, paint, cleaning solutions, and construction materials and more particularly to providing a container that is designed to prevent a child from drowning in the event the child should happen to fall into the container when it is partially filled with water or other liquid.

BRIEF DESCRIPTION OF THE PRIOR ART

Bucket-like containers, notably those commonly referred to as "five gallon plastic pails" are used to various consumer products such as foods, paint, cleaning substances, and construction materials (note: as used herein the terms "bucket" and "pail" are synonymous). Five gallon plastic pails are open-head containers with a rated capacity of about 4.5 to about 5.5 gallons and are generally about 14 to about 15 inches high and between about 10.25 to about 11.25 inches in diameter. They have nearly straight sides and usually are manufactured of high density polyethylene. When emptied of their original contents, such plastic containers are often reused as pails by consumers. It has been determined that a five gallon pail with some liquid in it is a potential drowning hazard if left unattended where it can be reached by a curious toddler A toddlers as young as 8-months may be strong enough to pull him or her self up far enough to lean over the pail. Because toddlers are top heavy. As a consequence, when a toddler leans over to peer into a pail, there is a tendency for the child to topple head first. Because of its shape, size and sturdiness, a conventional flat bottom five gallon plastic pail containing some liquid may not tip over when a toddler falls into it. Should that occur, the toddler may be unable to extricate itself, with the result that he or she drowns in the liquid in the pail. It has been determined that such drownings can occur with only a few inches of liquid in the bottom of the pail. The United States Consumer Safety Product Commission has determined from reports of deaths and non-fatal incidents associated with 5 gallon buckets that the ages of victims ranges from 7 months to 24 months, with a median age of 11 months. The height and weight of the reported victims averaged about 28 inches and 22 pounds respectively. The average height of the liquid in the buckets was about 6 inches.

In view of such drowning incidents, efforts have been made to provide protection against drowning. Three such efforts are disclosed in U.S. Pat. Nos. 5,183,179, 5,513,770 and 6,024,244. In U.S. Pat. No. 5,183,179, the container is formed with a child drowning protection guard in the shape of a tapered tube that is integral with the bottom wall of the container and extends upwardly from the bottom wall. The projection has a height and a diameter such as to prevent the child from drowning in liquid in the container. In U.S. Pat. No. 5,513,770, the drowning protection feature is in the form of an insert which can be screwed into a pail and is operable to prevent a child's head from entering the pail while allowing conventional household implements to be inserted into and withdrawn from the pail. In U.S. Pat. No. 6,024,244, the protection against drowning is achieved by a weighted convex safety attachment for the bottom of a container. All of the foregoing attempts, while laudable, suffer from limitations. In the case of U.S. Pat. No. 5,513,179, the projection in the container complicates the manufacture of the container and limits the size of implements that can be inserted into the container to the side of the projection. In the case of U.S. Pat. No. 5,513,770, the addition of an insert adds to the cost. Also, that feature suffers from the limitation that the user may forget to apply the drowning protection insert, with the result that a child may still peer into the container and run the risk of drowning as described above. The weighted convex safety attachment for the bottom of a container disclosed in U.S. Pat. No. 6,024,244 suffers from the fact that it introduces an increased cost since it is a separate component that is added to a standard flat bottom container. Also although it introduces more weight to lower the center of gravity, it does so by an increase in the overall height. Also the convex base of the safety attachment has a flat center portion that rests on a floor or other supporting surface for the container and has a small diameter, with the combination of that small diameter and the convex shape insuring that the container is unstable when left unattended. Accordingly when the container is in normal use, e.g., when it is standing alone, a removable stabilizing collar, sized and shaped to-fit around both the lower side of the container and the convex safety attachment, is utilized to provide stability and prevent the container from tipping. The stabilizing collar adds to the cost and also complicates warehousing and shipping since the presence of the stabilizing collars hampers the stacking of filled containers one upon the other and the storing and/or shipping of empty containers in nested relation, i.e., one empty container inside of another.

OBJECTS AND SUMMARY OF THE INVENTION

The object of the invention is to provide an open-head, nestable container of circular cross-sectional configuration that is shaped so that (a) it will stand upright on a flat support such as a floor, shelf or shipping pallet and (b) in the event that the container contains some water or other liquid and a toddler leans forward into the container, e.g., in an attempt to retrieve a toy that has fallen into the container, the weight of the child on the container will cause the container to tip over, thereby spilling the contents and preventing the child from drowning in the container.

Another object is to provide a container design with child drowning protection that can be made in different sizes without requiring different size covers.

The foregoing objects are achieved by providing a container with a bottom wall that is contoured in a manner that provides positional stability for the container when it is empty or partially or fully filled, yet makes it easy for the container to tip over when a toddler leans over and reaches into the container. Containers embodying the invention may be provided with covers that facilitate stacking covered containers one on top of the other. Additionally, the containers are formed with an inclined sidewall, whereby to permit the open empty containers to be nested one inside the other. Other features of the invention are described or rendered apparent by the following detailed description of a preferred embodiment of the invention which is to be considered together with the accompanying drawings.

DETAILED DESCRIPTION OF THE PREFERRED EMBODIMENT

Figure 3:
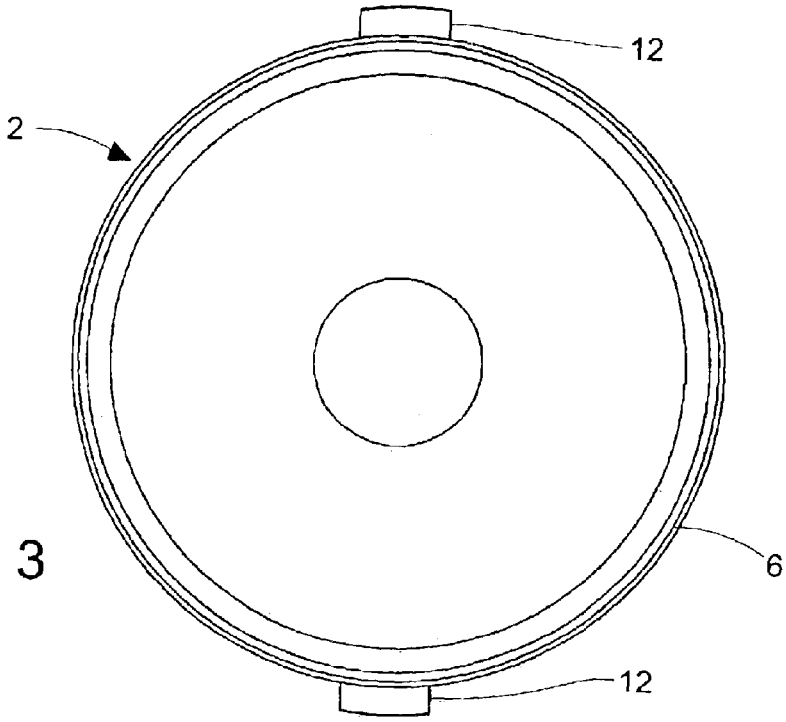
FIG. 3 is a plan view of the same container.
Figure 1:
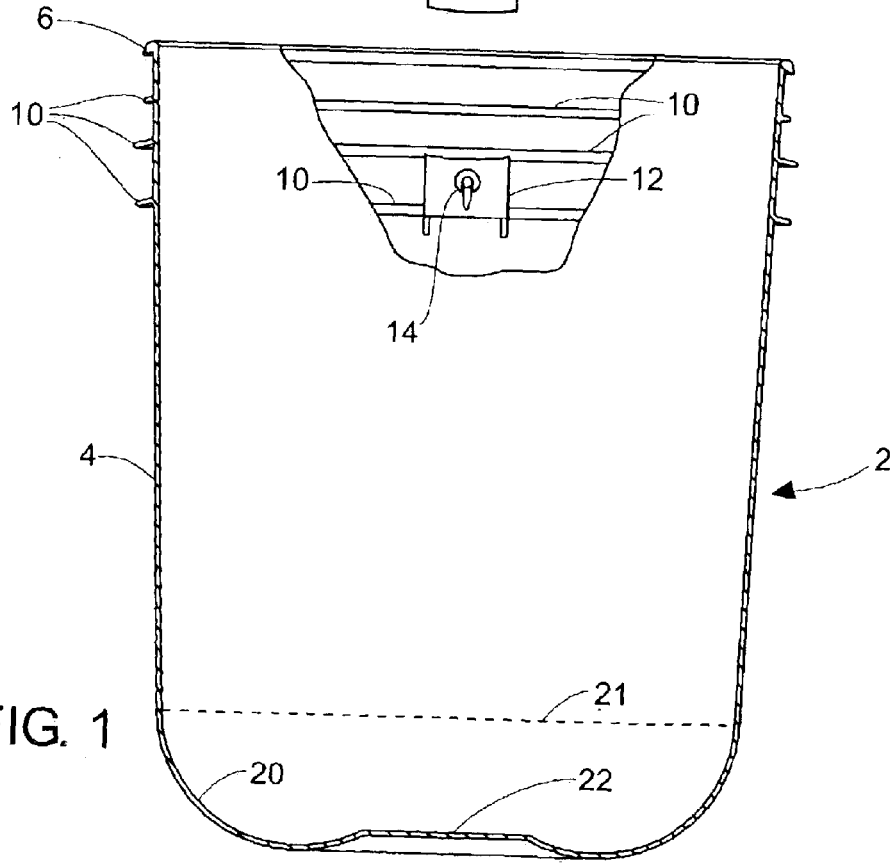
FIG. 1 is a side view in elevation of a container embodying the present invention.
Figure 2:
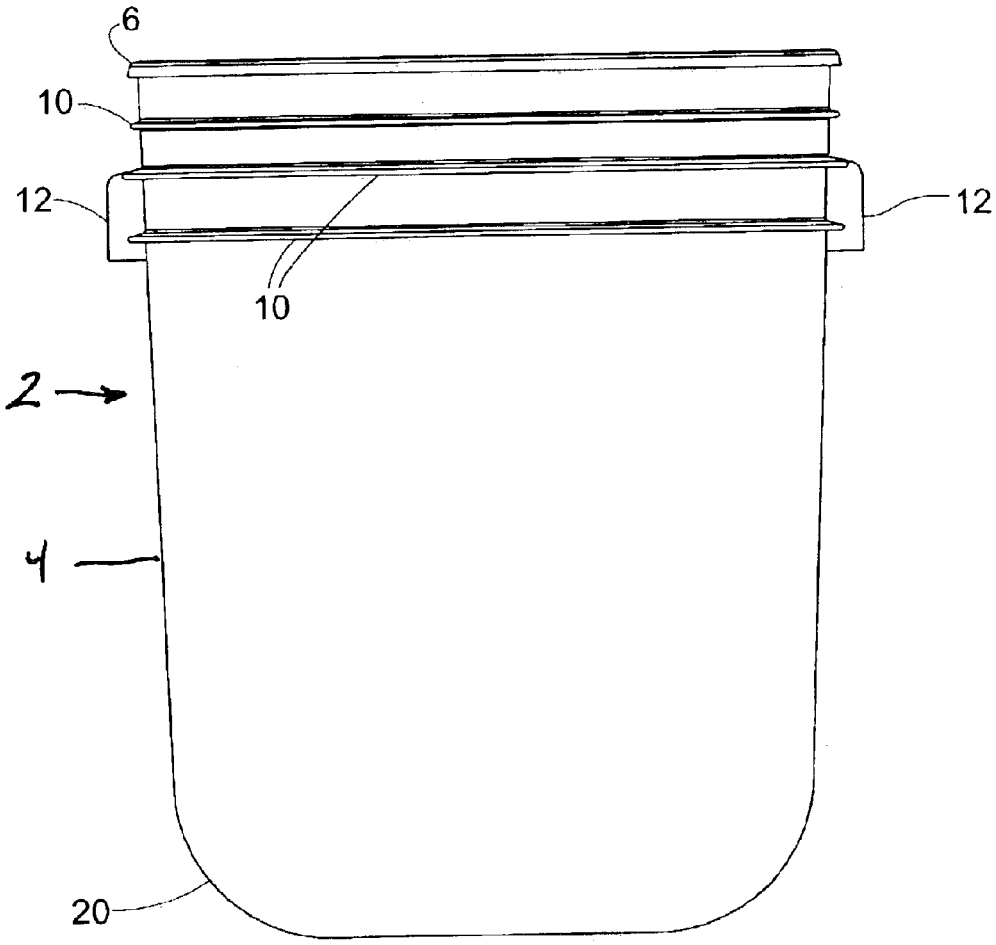
FIG. 2 is fragmentary vertical sectional view of the same container displaced 90d degrees from the viewpoint of FIG. 1.
Figure 5:
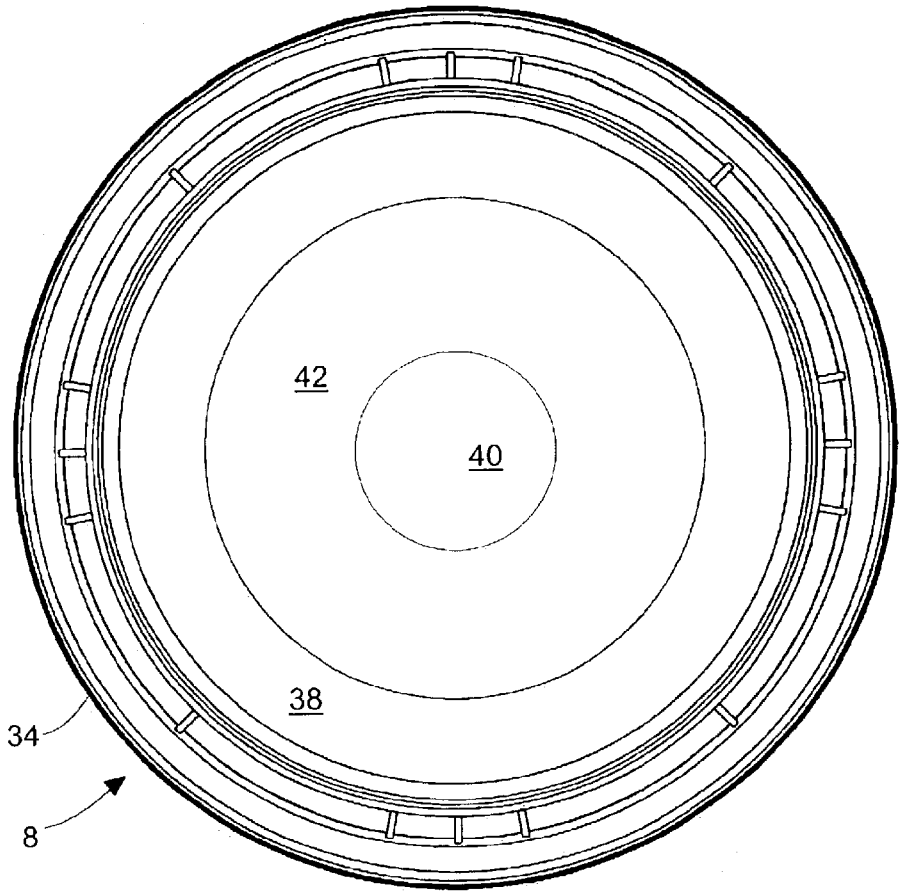
FIG. 5 is a bottom view of the cover.
Figure 4:
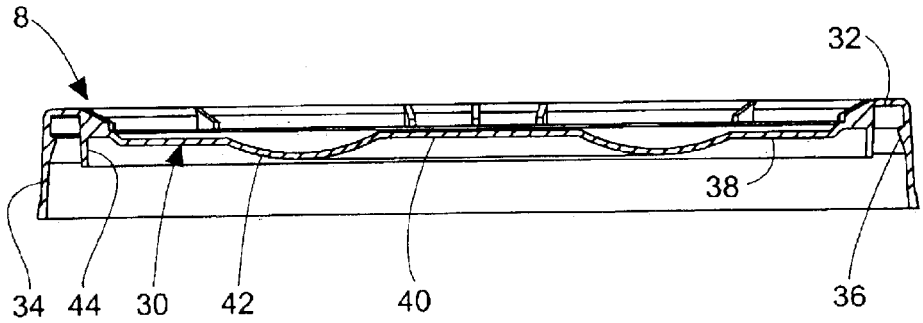
FIG. 4 is a sectional view of a cover for the container.
Figure 6:
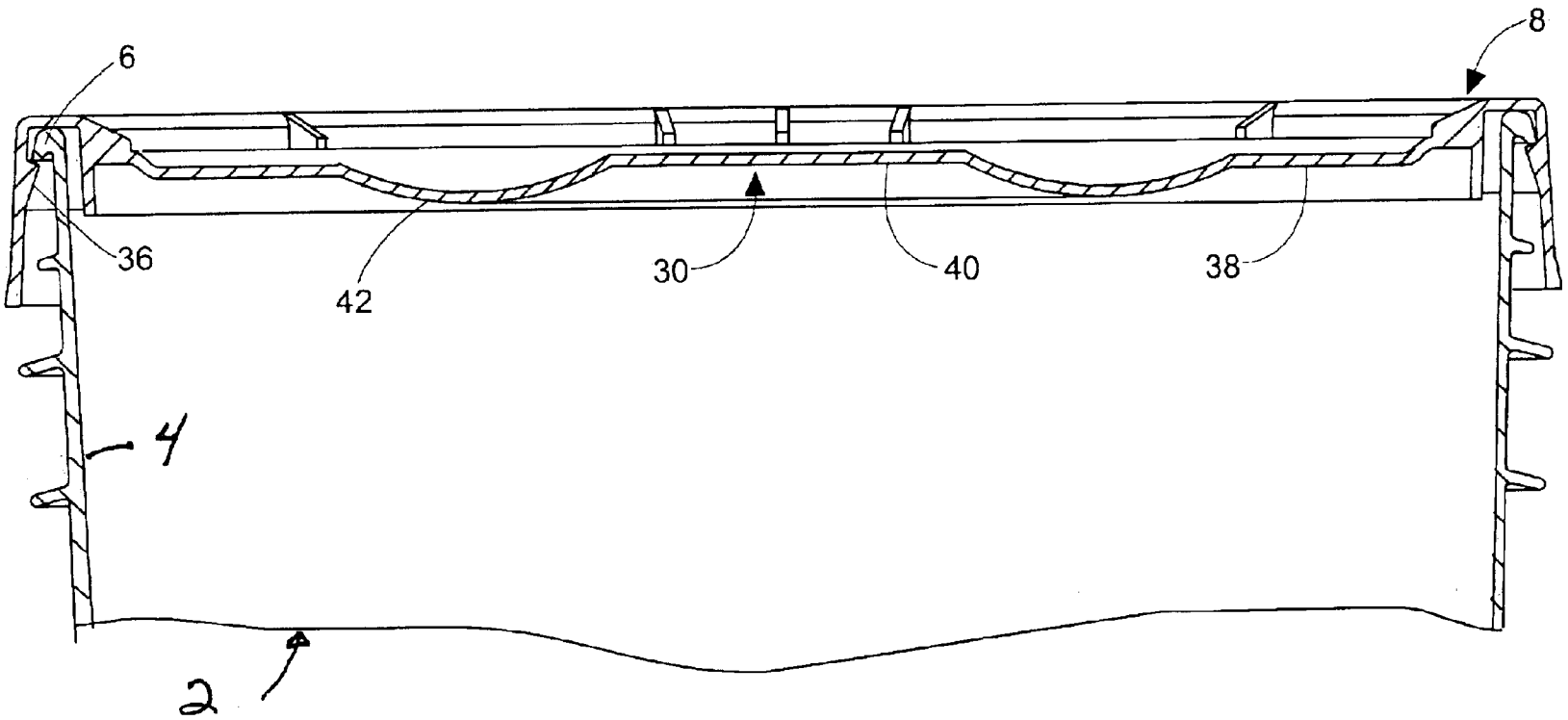
FIG. 6 is a cross-sectional view of the upper end of the container with the cover attached.
Figure 7:
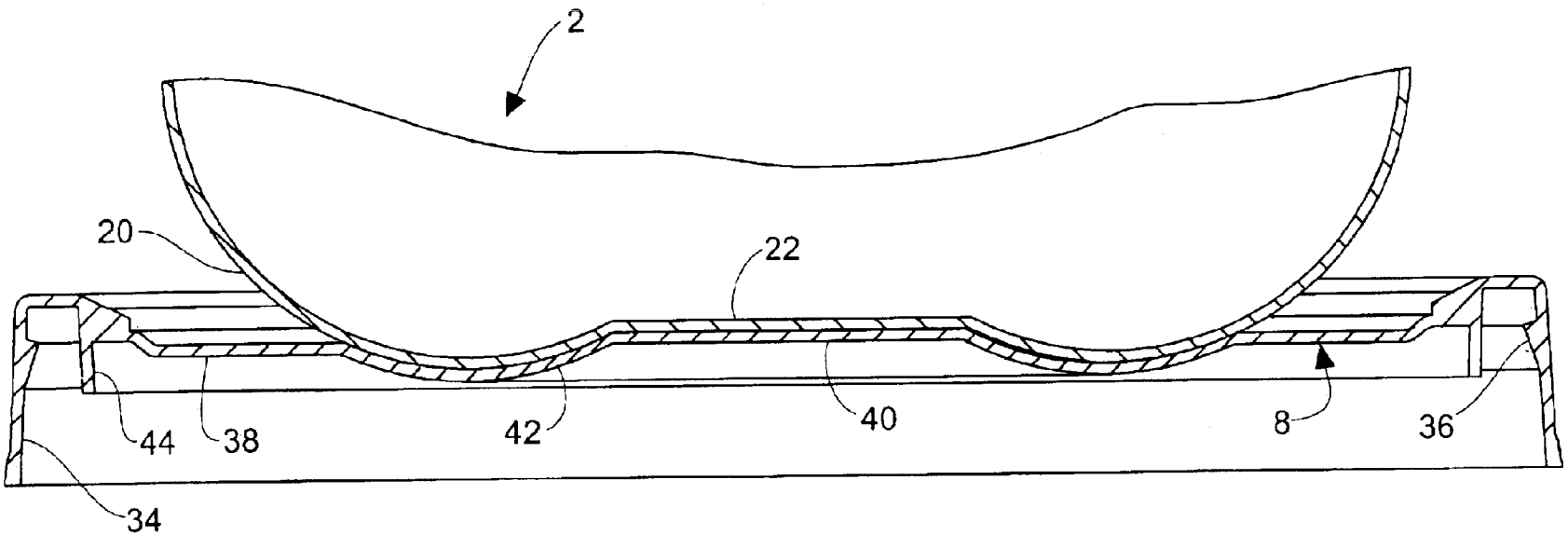
FIG. 7 is an enlarged view illustrating how the bottom end of one container is accommodated by the cover of another container.

Referring to FIGS. 1 and 2, the illustrated container 2 comprises a sidewall 4 that is circular in cross-sectional configuration but is tapered with a slight draft, preferably a draft of approximately 4.5°, in order to facilitate nesting of one container inside of another container. As seen best in FIGS. 1 and 3, the upper end of the container is formed with a peripheral lip 6 that is undercut so as to serve as a catch for a cover 8 as described hereinafter. The outer side of the sidewall is formed with several radially-extending flanges 10 adjacent its top eng and below lip 6. Two outwardly projecting ears 12 are formed integral with two of the flanges 10 at diametrically-opposed regions of the container. Ears 12 have holes 14 for receiving the ends of a curved bail (not shown) that serves as a handle and allows the container to function as a bucket or pail.

Still referring to FIG. 1, the bottom end of the container is curved and recessed so as to have an annular convex projecting section 20 that forms a continuation of the side wall and a recessed circular center section 22 that is substantially flat. For convenience of understanding, the junction of the convex section 20 with side wall 4 is indicated by the broken line 21 in FIG. 1. Preferably contoured section 20 has a single radius of curvature with the center of that radius being eccentric to the longitudinal axis of the container, i.e., the vertical center axis of the container as viewed in FIGS. 1 and 2. That radius of curvature has a magnitude that does not exceed and preferably is less than the diameter of recessed center section 22. Center section 22 has a diameter that is between about 30% to about 50% of the minimum diameter of side wall 4. Convex section 20 makes a circular line contact when rested on a flat supporting surface, e.g., a storage shelf, floor, deck or shipping pallet. The low point of convex section 20, i.e., the portion of that section that makes a circular line contact with a flat supporting surface, has an effective diameter that does not exceed one-half of the maximum diameter of the container and preferably has a smaller value. Additionally that effective diameter of the low point of convex section 20 is no less than 25% of the maximum diameter of the container but less than the minimum diameter of side wall 4. Preferably the low point of convex section 20 has a diameter of approximately 40–50% of the maximum outside diameter of the container. The foregoing requirements hold true for a container having a side wall of constant diameter and also a side wall that is inclined with a draft angle not exceeding about 5 degrees. If the side wall has a larger draft angle, the effective diameter of convex section 20 is increased as required to provide the proper balance of stability and tiltability when liquid is present in the container. Preferably center section 22 is recessed about 0.300 inch above the low point of convex section 20 but it may be recessed more or less than that amount.

In a preferred embodiment of the invention, the maximum inner diameter of the container at its top end is approximately 11.8 inches, its overall height is approximately 14.2 inches measured from the low point of the convex section 20 to its top end, side wall 4 has a draft angle of about 4.5 degrees, the minimum inside diameter of the side wall (i.e., where the side wall meets the convex section 12) is approximately 10.4 inches, the radius of curvature of convex section 20 in cross-section is approximately 2.5 inches, and recess section 22 has a diameter of about 3 inches and is recessed about 0.300 inch. With that design, the convex section 20 joins the side wall about 2.4 inches above the lowermost point of convex section 20, and a virtual projection of the outer surface of the side wall has a diameter of approximately 10.3 inches at the level of the lowermost point of the convex section 20. At the lip 6 the outside diameter of the container is approximately 12.0 inches and the thickness of the side wall is approximately 0.092 inch. The tiltability of the container when upright is a function of the effective diameter of the container measured at the low point of convex section 20, and in the preferred embodiment that effective diameter is approximately 5 inches. A bucket having the foregoing dimensions holds approximately 5 gallons of water and is identified herein as a "five gallon" container.

It has been determined that the amount of horizontal force required to tip a bucket incorporating the present invention varies with the amount of water in the container. Measurements were conducted with a "five gallon" container having the dimensions described above with different amounts of water to determine the amount of horizontal force required to tip the bucket. The results of those tests are set forth in table I:

TABLE I

| Depth of Water | Horizontal Force |
|---|---|
| 6 inches | 7 lbs |
| 10 inches | 8 lbs |
| 13.5 inches | 10 lbs |

A conventional five gallon plastic container having a substantially flat bottom, e.g., a container an inner diameter of 11.8 inches at its top end, an inner diameter of 10.1 inches at its bottom end, a wall thickness of about 0.090 inch, and a height of about 14.1 inches, cannot not achieve comparable results for the reason that application of a horizontal force merely causes the container to slide horizontally on its flat bottom. In this connection it is to be noted that such flat bottom containers have a tendency to slide toward a toddler as the toddler grips it and tries to pull himself or herself up on it, causing a forward momentum of the toddler and increasing the likelihood that the toddler will fall into the container without it tipping over.

It is to be noted that the U.S. child safety laws with regard to pails contemplates a toddler of 22 months of age being able to stand up and access a pail filled with water, and a toddler of that age would weight approximately 26 lbs. Accordingly, the amount of force resulting from a toddler leaning into a container of the type described would be much greater than the 10 lbs. noted in Table I. Consequently if a child in the age of 22 months should stand up next to a pail made according to the present invention and then attempt to reach into or bend over into the pail, the pail would tip before the toddler could be put in danger of drowning in the contents of the container.

Turning now to FIGS. 4–7, the cover 8 comprises a crown section 30 and a rim section 32. The latter section portion includes a depending skirt 34 that is formed with an inwardly directed projection 36 on its inner side for engagement with the lip 6 on the upper end of the container. The crown section of the cover is formed with a peripheral portion 38 that is recessed below the level of the upper surface of rim section 32, a flat circular center portion 40, and an annular portion 42 having a concave cross-sectional configuration disposed between sections 38 and 40. The crown also has a circular depending flange 44 that is sized to make a close fit within the upper end of container 2. Flange 44 acts to support the upper end of the container against radial compression. The concave annular portion 42 is shaped, sized and positioned to mate with the annular convex section 20 on the bottom side of a container 2 like the one shown in FIGS. 1–3, thereby allowing like containers 2 with like covers 8 to be stacked one upon the other. When so stacked, the nesting of the convex section 20 on the bottom of an upper container in the concave annular depression of annular portion 42 of a cover 8 on a lower container helps to restrain the covered containers from shifting laterally relative to one another in the stack. Additionally, since preferably the container sidewall is formed with a draft angle of approximately as herein illustrated and described, if the containers do not have their covers on, they may be nested inside one another to save space for shipping and storing purposes.

By way of observation, in the preferred embodiment of the invention the container has a height that is approximately 1.4 times the diameter of the virtual straight line projection of the side wall down at the level of the lowermost point of the annular convex bottom wall section 20, and the portion of that annular protuberance that makes a circular line contact with a flat supporting surface has a diameter that is approximately 0.6 times the diameter of that virtual projection of the side wall at the level of the lowermost point of the convex annular protuberance. That ratio is offered as a guideline rather than a restriction with respect to practicing the invention.

An interesting aspect of the invention is that the capacity of the container described above may be changed without requiring a different size cover or altering the shape or dimensions of the bottom end of the container, i.e., the portion of the container below the bottom end of side wall 4 as represented by line 21. More specifically, the container describe above can be modified to provide a capacity ranging from about 3.5 to about 6.5 gallons, without changing the diameter at the upper end of the container or the dimensions or contour of the convex projecting section 20 and/or recessed center section 22, by (1) altering the height of the side wall 4 and (2) making an appropriate change in the draft angle of side wall 4. It is contemplated that such change in capacity may involve providing side wall 4 with a single draft angle or a draft angle that changes from top to bottom, e.g., a first draft angle commencing where side wall 4 joins convex section 20 and extending for a limited distance along the length of side wall, and a second draft angle extending for the remainder of the length of the side wall. It is to be noted that, regardless of whether side wall 4 has a single or plural draft angle, modifying the container to provide a capacity of 3.5 or 6.5 gallons, for example, can be accomplished according to the invention without changing the diameter of the bottom end of side wall 4, i.e., the diameter at the level of line 21. Hence the specific mold design for the bottom of a 5 gallon container embodying the invention may be used unaltered for other containers of different total holding capacity.

A primary advantage of the invention is that it provides drowning protection for a child. Additionally, it offers the advantage that existing container designs may be modified to incorporate a contoured bottom wall as herein described, and that such containers embodying the invention would be no more expensive to manufacture than that of a conventional flat-bottomed container of comparable size and of like purpose. Furthermore the containers may be filled and the covers attached thereon using conventional filling and capping machinery. Still another advantage is that although the invention as been described and illustrated in connection with so-called 5 gallon pails, it may be embodied in containers of other sizes and also containers that lack ears as shown as 12 for accommodating bails or handles and hence are not designed to serve as pails or buckets. For example, the containers may be formed with a pair of diametrically opposed projecting portions that can serve as grips or handles for lifting the container. Accordingly the particular dimensions and curvature values set forth above may be changed for containers of smaller or greater dimensions. It also is contemplated that the invention may be practiced with containers having straight rather than tapered side walls.

Other possible modifications and advantages will be obvious to persons skilled in the art.

What is claimed is:

1. A container/cover assembly for containing a liquid substance and which provides protection against a toddler drowning as a result of falling into the container when its cover has been removed, said assembly comprising:

a container having an open top end and a closed bottom end defined by a side wall and a bottom wall formed integral with the side wall, said side wall being circular in cross-section and having a maximum diameter at said top end and said container having a height that substantially exceeds the magnitude of said maximum diameter, said bottom wall being characterized by an annular protuberance concentric with said side wall and surrounding a recessed section of said bottom wall, said annular protuberance being an integral extension of said side wall and having a curved convex shape in cross-section that extends from said recessed section to said side wall, the diameter of said recessed section and the radius of curvature of said convex shape in cross-section being sized so that when the container is placed top end up on a floor or other supporting surface a circumferentially-extending portion of said annular protuberance located between said side wall and said recessed section will make a circular line contact with said floor or other supporting surface, with said circular line contact having a diameter that does not exceed said maximum diameter so that in the event that a toddler should fall head first into the open container while the container contains a liquid, the weight of the toddler exerted on the top end of the container will cause the container to tip over so as to spill the liquid and prevent the toddler from drowning; and a cover for closing off said open top end of said container, said cover being characterized by a rim section and a crown section surrounded by said rim section, said rim section being adapted to make a locking connection with said side wall of said container, and said crown section being characterized by an annular portion in the form of a concave depression having a curved cross-sectional configuration such that said annular protuberance of another like container will make a close fit in said depression.

2. A container/cover assembly according to claim 1 wherein said side wall has an outer surface and a circumferential radial projection on said outer surface, and said rim section comprises a top portion that projects above said crown section and a peripheral skirt that extends below said crown section, said skirt having an inner surface and means on said inner surface for making a snap locking connection with said radial projection, whereby to lock the cover to the container so as to close off said open top end.

3. A container for containing a liquid substance and which provides protection against a toddler drowning as a result of falling into the container, said container comprising an open top end and a closed bottom end formed by a side wall and a bottom wall that is integral with the side wall, said side wall being circular in cross-section and having a maximum diameter and a height that exceeds its maximum diameter, said bottom wall being characterized by an annular protuberance concentric with said side wall, said annular protuberance having a curved convex shape in cross-section and constituting an integral extension of said side wall, and said annular protuberance projecting below the bottom end of said side wall and being shaped to make a circular line contact with a floor or other flat supporting surface inwardly of said side wall with said circular line contact having a diameter that does not exceed said maximum diameter, whereby if a toddler falls head first into the container while the container contains a liquid, the weight of the toddler exerted on the top end of the container will cause the container to tip over so as to spill the liquid and prevent the toddler from drowning.

4. A container according to claim 3 wherein said convex shape has a circular curvature.

5. A container according to claim 3 wherein said sidewall has a minimum diameter and said bottom wall has a recessed circular center section surrounded by said annular protuberance, said recessed center section having a diameter that is between about 30% to about 50% of said minimum diameter of said side wall.

6. A container according to claim 5 wherein said container has a height of approximately 14.2 inches, said side wall is tapered inwardly from top to bottom with a draft angle of about 4.5 degrees and has a maximum outside diameter of about 11.9 inches, and said center section has a maximum diameter of approximately 3 inches.

7. A container according to claim 6 wherein the portion of said annular protuberance that makes said circular line contact with a flat supporting surface is characterized by a diameter of approximately 5 inches.

8. A container according to claim 3 having a height that is approximately 1.4 times the diameter of the virtual projection of said side wall at the level of the lowermost point of said annular protuberance, and further wherein the portion of said annular protuberance that makes said circular line contact with a flat supporting surface has a diameter that is approximately 0.6 times the diameter of said vital projection of said side wall at the level of the lowermost point of said annular protuberance.

9. A container for containing a liquid substance and which provides protection against a toddler drowning as a result of falling into the container, said container comprising an open top end and a closed bottom end formed by a side wall and a bottom wall that is integral with the side wall, said side wall having a maximum diameter at said open top end and said container having an overall height measured between said open top end and said bottom end that is greater than said maximum diameter of said side wall, said bottom wall comprising an outer annular section that is an integral extension of said side wall and a recessed center section that is surrounded by and forms an integral extension of said outer annular section, said outer annular section having a convex circular curvature in cross-section whereby a circular portion of said outer annular section located between said outer wall and said recessed center section will make a circular line contact with a floor or other flat surface on which the container may be supported, said circular line contact having a diameter that does not exceed one half of said maximum diameter of said side wall and said annular section having a single radius of curvature in cross-section such that should a toddler fall head first into the container while the container contains a liquid, the weight of the toddler exerted on the top end of the container will cause the container to tip over so as to spill the liquid and prevent the toddler from drowning.

10. A container for containing a liquid substance and which provides protection against a toddler drowning as a result of falling into the container, said container having an open top end and a closed bottom end defined by a side wall and a bottom wall, said side wall having a maximum diameter and said container having a height that exceeds said maximum diameter, said bottom wall being characterized by an annular protuberance concentric with said side wall and a circular recessed center section surrounded by said annular protuberance, said annular protuberance extending between and formed integral with said recessed center section and said side wall, said annular protuberance having a curved convex configuration in cross-section so that a circular section of said annular protuberance located inwardly of said side wall is located furthest from said open top end and constitutes the lowest portion of said bottom wall, whereby when said container is placed top end up on a flat supporting surface said circular section of said annular protuberance will make a circular line contact with said supporting surface so that in the event that a toddler should fall head first into the open container while the container contains a liquid, the weight of the toddler exerted on the top end of the container will cause the container to tip over so as to spill the liquid and prevent the toddler from drowning.

11. A container according to claim 10 in combination with a cover for closing off said open top end of said container, said cover being characterized by a rim portion and a central body portion surrounded by said rim portion, said rim portion being adapted to make a lacking connection with said side wall of said container, and said central body portion being characterized by an annular depression having a curved cross-section such that said annular protuberance of another like container will make a close fit in said depression.

12. A container according to claim 10 wherein said side wall has a circular configuration in cross-section and further wherein said side wall has a draft angle not exceeding 5 degrees.

13. A container according to claim 10 wherein said recessed section and the radius of curvature of said annular protuberance are sized so that when said container is rested on a flat surface with said top end facing up said lowest portion of said bottom wall will make a circular line contact with said flat surface, characterized by said circular line contact having a diameter that is approximately 0.6 times the diameter of a virtual projection of said side wall at the level of said lowest portion of said bottom wall.

14. A container/cover assembly according to claim 1 wherein said crown section comprises a flat center portion surrounded by said annular portion and a peripheral portion surrounding said annular portion, said crown section extends below the level of said top portion of said rim section, and said annular portion has a concave upper surface that is sized and shaped so that when another like container is positioned with its bottom end resting on said cover, the annular protuberance of said another like container will be disposed in said depression and in contact with said concave surface.

15. A container according to claim 10 wherein said lowest portion of said bottom wall that makes a circular line contact with a supporting surface has a diameter that does not exceed one-half of said maximum diameter.

16. A container according to claim 15 wherein said lowest portion of said bottom wall that makes a circular line contact with a supporting surface has a diameter that is no less than 25% of said maximum diameter.

17. A container according to claim 16 wherein said container has a height of about 14 to about 15 inches and diameter of about 10.25 to about 11.25 inches, said annular protuberance has a radius of curvature in cross-section of approximately 2.5 inches, and said recessed section has a diameter of about 3 inches.

18. A container according to claim 10 wherein said container has a height of about 14 to about 15 inches and diameter of about 10.25 to about 11.25 inches, said annular protuberance has a radius of curvature in cross-section of approximately 2.5 inches, and said recessed section has a diameter of about 3 inches.

19. A container according to claim 18 wherein said recessed section is recessed about 0.300 inch above said lowest portion of said bottom wall.

20. A container according to claim 17 wherein the effective diameter of said circular section that forms the lowest portion of said bottom wall is approximately 5 inches.

* * * * *

UNITED STATES PATENT AND TRADEMARK OFFICE

CERTIFICATE OF CORRECTION

PATENT NO. : 6,920,998 B2
DATED : July 26, 2005
INVENTOR(S) : David W. Diamond

It is certified that error appears in the above-identified patent and that said Letters Patent is hereby corrected as shown below:

Column 7,
Lines 28 and 29, change “recessed circular” to -- circular recessed --;
Line 48, change “vital” to -- virtual --;

Column 8,
Line 35, change “lacking” to -- locking --.

Signed and Sealed this

Twenty-ninth Day of November, 2005

JON W. DUDAS
*Director of the United States Patent and Trademark Office*